US007441928B2

(12) United States Patent
Futami

(10) Patent No.: US 7,441,928 B2
(45) Date of Patent: Oct. 28, 2008

(54) LIGHTING DEVICE

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 15 days.

(21) Appl. No.: 11/736,216

(22) Filed: Apr. 17, 2007

(65) Prior Publication Data

US 2007/0242463 A1 Oct. 18, 2007

(30) Foreign Application Priority Data

Apr. 17, 2006 (JP) ..... 2006-113810

(51) Int. Cl.
*F21V 7/00* (2006.01)

(52) U.S. Cl. ..... 362/298; 362/517; 362/518; 362/302

(58) Field of Classification Search ..... 362/517, 362/518, 297, 298, 301, 302, 346
See application file for complete search history.

(56) References Cited

U.S. PATENT DOCUMENTS

| | | | | |
|---|---|---|---|---|
| 6,419,380 | B2 * | 7/2002 | Oyama et al. | 362/517 |
| 6,575,609 | B2 * | 6/2003 | Taniuchi et al. | 362/517 |
| 6,948,836 | B2 | 9/2005 | Ishida et al. | |
| 6,951,416 | B2 | 10/2005 | Sazuka et al. | |
| 7,347,600 | B2 * | 3/2008 | Albou | 362/517 |
| 2005/0041434 | A1 | 2/2005 | Yatsuda et al. | |
| 2005/0057917 | A1 | 3/2005 | Yatsuda et al. | |

FOREIGN PATENT DOCUMENTS

| | | |
|---|---|---|
| JP | 2003317513 | 11/2003 |
| JP | 2004095479 | 3/2004 |
| JP | 2005063706 | 3/2005 |
| JP | 2005093191 | 4/2005 |
| JP | 2005209538 | 8/2005 |

* cited by examiner

*Primary Examiner*—Thomas M Sember
(74) *Attorney, Agent, or Firm*—Cermak Kenealy & Vaidya LLP

(57) ABSTRACT

A lighting device can include at least one LED light source having at least one LED chip, the LED light source being configured to impart a certain directivity to light emitted from the LED chip in a direction of the optical axis of the light source. A first reflector can be disposed in front of the LED light source and upwards with respect to the optical axis. The first reflector can also extend forward and above the optical axis in an inclined manner from a first side to a second side so as to reflect part of light emitted from an upper part of the LED light source with respect to the optical axis. A second reflector can be disposed substantially in parallel to, and below, the first reflector. The second reflector can be configured to reflect light from the first reflector. A third reflector can be disposed in front of the LED light source and downward with respect to the optical axis. The third reflector can extend forward and below the optical axis in an inclined manner from the second side to the first side so as to reflect part of light emitted from a lower part of the LED light source with respect to the optical axis. A fourth reflector can be disposed substantially in parallel to, and above, the third reflector. The fourth reflector can also be configured to reflect light from the third reflector.

27 Claims, 8 Drawing Sheets

LIGHTING DEVICE

This application claims the priority benefit under 35 U.S.C. § 119 of Japanese Patent Application No. 2006-113810 filed on Apr. 17, 2006, which is hereby incorporated in its entirety by reference.

BACKGROUND

1. Technical Field

The presently disclosed subject matter relates to lighting devices for use in vehicle headlights, fog lights, and other lights for a vehicle or vehicle and traffic applications.

2. Description of the Related Art

In general, a conventional LED light source is configured to include a single LED chip and a lens portion shaped as a so-called "cannonball type" package enclosing the LED chip.

Such an LED light source has high light take-out efficiency from the light source package and is available at a low cost. However, an LED light source with the above structure cannot serve as a linear light source like a linear filament of an incandescent lamp because of its intrinsic characteristics.

Typical vehicle headlights are arranged as high as about 60 cm away from the road surface and are configured to irradiate the road in front of the vehicle from that position. This type of vehicle headlight forms a specific light distribution pattern in which the area of the road just in front of the vehicle is not so brightly illuminated while the far-away area is illuminated with a certain intensity light, i.e., a horizontally wide light distribution. In view of this, the above-described LED light source is not suitable for use as a light source in a vehicle headlight.

Consider a vehicle headlight that utilizes a parabolic reflector, for example. In this case, such a vehicle headlight can be configured to provide a passing-by light distribution (or a low beam distribution) including a cut-off area between a bright area and a dark area in order to prevent a glare light against an opposed vehicle. The above-described LED light source, however, does not have high contrast at its light emitting portion. Accordingly, it is difficult to form such a low beam distribution.

In order to solve the above-mentioned problems, specific LED light sources for headlights have been developed and are disclosed, for example, in Japanese Patent Laid-Open Publications No. 2005-093191 and No. 2005-063706 and their respective English translations, the disclosures of which are hereby incorporated in their entireties. The LED light source described has a plurality of LED light sources configured in line to form a multi-chip type LED, thereby serving as an elongated light source.

There are other problems in that the current LED light source is significantly low in intensity as compared to a halogen lamp and a high intensity discharge (HID) burner, which are used as vehicle lighting devices. In order to solve this problem, a united LED light source is composed of a plurality of the above-mentioned LED type light sources, and a required number of the thus obtained united LED light sources are combined to obtain a vehicle lighting device with a required light intensity (for example, see Japanese Patent Laid-Open Publications No. 2003-317513 and No. 2004-095479 and their respective English translations, the disclosures of which are hereby incorporated in their entireties).

Alternatively, a large sized LED chip can be used to obtain a higher intensity light for use as a headlight while decreasing the number of the LED light sources used. In this case, however, a relatively large current is required for driving such a large-sized LED chip. In addition to this, a large amount of heat may be generated from the energized LED chip. Accordingly, if such a large-sized LED chip which requires a large current is used, this type of headlight needs a large radiator (see, for example, Japanese Patent Laid-Open Publication No. 2005-209538 and its respective English translation, the disclosure of which is hereby incorporated in its entirety).

Furthermore, novel exterior designs using LED light sources are required for not only headlights, but also for various vehicle lighting devices such as rear lights, high mount stop lights, positioning lights, cornering lights, traffic lights and the like.

Conventionally, some different types of vehicle lighting devices using an LED light source are put to practical use, including a direct illumination type lighting device using an LED light source, a reflection and diffusion type lighting device using a reflector for reflecting light from the LED light source, and a diffusion type lighting device using a lens cut for diffusion.

However, technologies disclosed in Japanese Patent Laid-Open Publications No. 2005-093191 and No. 2005-063706 have problems in that part of the light emitted from respective LED chips impinges on adjacent LED chips and is prevented from being emitted outwards. This may increase light loss and lower light take-out efficiency for the LED.

In case of multi-chip type LEDs, the design and manufacturing requirements for multi-chip type LEDs may increase the entire cost related to these products. Furthermore, because multi-chip type LEDs are not typically configured as a general-purpose type lamps, but are configured to be a dedicated light source for use in headlights, the LED packages are expensive.

The structures having a plurality of united LED light sources disclosed in Japanese Patent Laid-Open Publications No. 2003-317513 and No. 2004-095479 require high level positioning accuracy and assembly accuracy for each of the light sources. Accordingly, it is difficult to suppress variation in the optical axis alignment due to the above-mentioned causes to a certain level. In order to accurately align the optical axes of the united light sources with each other, an optical axis adjustment mechanism is required for each of the LED light sources of the above configuration, resulting in a complex structure and assembly.

Furthermore, the structure disclosed in Japanese Patent Laid-Open Publication No. 2005-209538 may require a large and complex attachment structure for a large radiator, as well as a space for attaching the large radiator. This means that the depth of the LED light source may be 100 mm or larger, and therefore, the entire united light source may be made larger and heavier. With respect to design considerations, it is difficult to use such a lamp as a vehicle lighting device, for example, as a rear light which is required to be relatively thin.

Various vehicle lighting devices that use an LED light source include direct-emission types in which the LED light source functions as a point source. When a vehicle lighting device employs a plurality of such LED light sources, light emitted from the lighting device may result in a granular sense to viewers. A vehicle lighting device in which light emitted from an LED light source can be diffused by a reflector or a lens cut to serve as a surface light source device.

Accordingly, there has been great difficulty in developing a vehicle lighting device that uses an LED as a light source and which has a linear light emission part with a narrow width.

In particular, a typical center high mount stop light is generally located on a rear window, and should have a vertical dimension (vertical width) as narrow as possible in order to ensure a rear field of view. When configuring such a linear light source using LEDs, a plurality of LEDs is typically arranged in line. Accordingly, the vertical width is approximately in the range of 15 mm to 20 mm. When configuring a linear light source, if the vertical width is required to be narrower, it may be necessary to cover the upper and lower areas of the light source, thereby disadvantageously shielding light from these areas. This may deteriorate the light take-out efficiency of the LEDs. Therefore, in order to obtain a linear light source utilizing an LED light source, this technique has not yet been realized or efficiently developed.

SUMMARY

In view of the above-described and other problems, the presently disclosed subject matter can include a lighting device, in particular a vehicle lighting device, having a simple configuration with a narrower vertical width provided at lower relative cost and without deterioration in the light take-out efficiency. A lighting device made in accordance with principles of the presently disclosed subject matter should also provide high versatility.

In accordance with one aspect of the presently disclosed subject matter a lighting device can be configured to include: an LED light source having at least one LED chip, the LED light source being configured to impart a certain directivity to light emitted from the LED chip in a direction of an optical axis thereof; a first reflector disposed in front of the LED light source upwards in the direction of the optical axis, the first reflector extending forward and above the optical axis in an inclined manner from a first side to a second side so as to reflect part of light emitted from an upper part of the LED light source with respect to the optical axis; a second reflector disposed substantially in parallel to, and below, the first reflector, the second reflector being configured to reflect light from the first reflector; a third reflector disposed in front of the LED light source downwards in the direction of the optical axis, the third reflector extending forward and below the optical axis in an inclined manner from the second side to the first side so as to reflect part of light emitted from a lower part of the LED light source with respect to the optical axis; and a fourth reflector disposed substantially in parallel to, and above, the third reflector, the fourth reflector being configured to reflect light from the third reflector.

The light, to which a predetermined directivity is imparted and which is emitted from the center part of the LED light source with respect to the optical axis center, can travel forward and illuminate with a predetermined light distribution pattern due to the imparted directivity. Part of the light emitted from the upper part of the LED light source with respect to the optical axis center is reflected by the first reflector slightly downward and towards the first side. Then the reflected light is incident on the second reflector. The incident light is reflected by that second reflector forward and substantially horizontally.

Part of the light emitted from the lower part of the LED light source is reflected by the third reflector slightly upward and towards the second side. Then the reflected light is incident on the fourth reflector. The incident light is reflected by that fourth reflector forward and substantially horizontally.

Namely, in the above described exemplary lighting device of the presently disclosed subject matter the light from the upper part and that from the lower part of the light emitting surface of the LED light source are reflected by the first and third reflectors, respectively, so as to be directed rightwards and leftwards to the center at the same horizontal level. Then, the light reflected by the first reflector and that by the third reflector are reflected again by the second and fourth reflectors. Accordingly, the reflected light is irradiated from both right and left sides and forward at the same level as the center area of the light emitting surface of the LED light source.

The irradiated light emitted from the thus configured lighting device can have a narrower vertical width than the width of the light emitting surface of the LED light source. This is achieved by the first and third reflectors which can reflect light toward the same level as the center area. Thus, the lighting device can have a light emitting portion with a narrower width.

In other words, in accordance with the above aspect of the lighting device of the presently disclosed subject matter, almost all of light emitted from the upper, center, and lower parts of the LED light source can be irradiated forward. In this instance, there may be a reflectance loss of light by the respective reflectors. However, an improvement in light take-out efficiency of light emitted from the LED light source can be realized as compared to the conventional lighting device which has a narrow light emitting area formed by shielding the upper and lower light from the LED lighting device. Therefore, the lighting device described above can provide a light distribution property with a sufficient light intensity. This means that the number of LED light sources can be reduced as compared to the number used in conventional lamps, thereby also reducing manufacturing costs as well as running or operating costs. It is also possible to save electric energy with such a lamp.

In addition to this, in order to obtain a higher light intensity, it is not necessary to use a high power LED device in the lighting device of the presently disclosed subject matter. Accordingly, a smaller heat radiator such as a radiator made of plate parts is sufficient for that purpose. Moreover, a large-sized aluminum heat sink or the like is not required. The smaller heat radiator can reduce the depth of the lighting device, which leads to the reduction in size and weight of the entire lighting device. This also provides an enhanced degree of freedom for design of the lighting device.

Since the shape of the light emitting surface in the above-described lighting device can have a narrow width, the linear shape can provide a high contrast light distribution. Accordingly, it is possible to easily provide a lighting device such as a headlight with a horizontally long light distribution property with high contrast. This eliminates the need to provide a multi-chip type light source dedicated for a headlight, resulting in a lower cost LED type headlight. Furthermore, the narrow width light emitting shape, which has conventionally been difficult to provide, can be configured as a rear light, for example, with a novel appearance. The above-described narrow width light emitting shape lighting device can advantageously be utilized to provide another function by means of the specifically designed light emitting portion of the lighting device, thereby enhancing the degree of freedom in design.

In the above-described lighting device, the first and second reflectors and the third and fourth reflectors may be rotationally symmetric with respect to the optical axis of the LED light source. In an exemplary embodiment, the first reflector may be disposed at a position corresponding to the upper one-third area of the light emitting surface of the LED light source with respect to the centrally located optical axis and may have a wider width than the light emitting surface. In addition to this, the third reflector may be disposed at a position corresponding to the lower one-third area of the light emitting surface of the LED light source with respect to the optical axis. Further to this, the second and fourth reflectors may be disposed at the same level as that of the center one-third area of the light emitting surface of the LED light source. In this instance, the light emission positions in the forward direction of the light reflected by the respective reflectors are displaced to the same level as the center one-third area of the LED light source. This means the entire lighting device can provide a light emitting portion with a vertical width as narrow as one third of the light emitting surface of the LED light source, namely, a narrow width light emitting surface can be provided.

In the above-described lighting device, the LED light source can be supported by an attachment member, and a molded part can be integrally formed with the attachment member. The first to fourth reflectors can be constituted by the molded part (specifically the surface of the molded part). The molded part can include upper and lower halves which are separated at the center and each have at least one reflecting surface being subjected to reflection surface treatment. Furthermore, a plurality of the LED light sources may be provided. In this instance, the attachment member can be shared by the LED light sources. Accordingly, the first to fourth reflectors can be accurately and easily positioned with respect to a corresponding one of the LED light sources. This can eliminate any optical axis adjustment mechanism, and facilitate easy assembly with a simple structure. This can also reduce the assembly cost for the lighting device.

The molded part of the lighting device can have a light emission portion with respect to the LED light sources, and the light emission portion may be provided with a lens subjected to diffusion prism processing, a diffusion sheet, a diffusion lens, or other light diffusion members. In this instance, light directly from the LED light source and light reflected by the first to fourth reflectors may be irradiated forwards after being diffused by the light diffusion member. In the above-mentioned configuration, the light diffusion member can be formed integrally with the molded part. By doing so, it is not necessary to position the light diffusion member with respect to the optical axis, thereby facilitating assembly at low cost.

In the lighting device, the light emission portion of the LED light source can be provided with a sheet to which a phosphor material is applied. In this instance, the light rays emitted directly from the LED lighting source and those reflected from the first to fourth reflectors are incident on the phosphor-applied sheet. Then, the light is wavelength converted by the phosphor to thereby be irradiated forwards. The phosphor-applied sheet can be formed integrally with the molded part. By doing so, it is not necessary to position the phosphor-applied sheet with respect to the optical axis, thereby facilitating assembly at low cost.

The lighting device can have an additional reflector made of a parabolic surface, a multi-reflector surface, a free curved surface, or the like surface. The additional reflector has a focus so that the light emitting portion of the LED light source is disposed in the vicinity of the focus of the additional reflector. In this instance, the light rays emitted directly from the LED light source and those reflected by the first to fourth reflectors are reflected by the additional reflector towards the front. The additional reflector may be formed integrally with the molded part. By doing so, it is not necessary to position the additional reflector with respect to the optical axis, thereby facilitating assembly at low cost.

The lighting device can have a lens including a projector lens, a cylindrical lens, or the like. The lens has a focus so that the light emitting portion of the LED light source is disposed in the vicinity of the focus of the lens. In this instance, the light rays emitted directly from the LED light source and those reflected by the first to fourth reflectors are directed and converged by the lens towards the front. The lens may be formed integrally with the molded part. By doing so, it is not necessary to position the lens with respect to the optical axis, thereby facilitating assembly at low cost.

The lighting device can have a plurality of LED light sources, and some of the LED light sources can be arranged such that the first to fourth reflectors reflect light in a direction inclined from the front to the first side. The light emitted from the LED light sources is reflected by the corresponding first to fourth reflectors to be irradiated in the direction inclined in a predetermined direction. When traveling along a curved road, for example, those particular LED light sources are turned on, and function as a cornering light to ensure visibility in the traveling direction of a vehicle.

The lighting device can have a plurality of LED light sources, and the LED light sources can have respective LED chips with different colors. In this instance, the respective colored LED chips can be adjusted in luminous intensity. This can provide emitted light with a desired color.

The lighting device can have a plurality of LED light sources, and each of the LED light sources can be adjusted in luminous intensity. By that adjustment, the lighting device can provide a desired light distribution property.

The lighting device can have a plurality of LED light sources, and some of the LED light sources including the first to fourth reflectors can be arranged at a position such that the LED light sources are rotated around the optical axis. For example, some LED light sources can be arranged not only horizontally, but also diagonally or vertically. Such a lighting device that includes horizontally, diagonally, and/or vertically arranged LED light sources can provide various unique appearances.

The lighting device can emit light forwards at the same level as that of the center area of the light emitting surface of the LED light source by reflecting the light from the upper and lower areas of the light emitting surface by means of the first and second reflectors and the third and fourth reflectors, respectively. Accordingly, the width of the light emitting portion can be narrowed as compared to the vertical width of the light emitting surface of the LED light source by means of the first and third reflectors, thereby providing a lighting device having a narrow width light emitting area. In addition to this, the light reflected by the first and third reflectors is further reflected by the respective second and fourth reflectors forwards. Accordingly, except for the reflection loss of light due to the reflectivity of the reflector, almost all of the light emitted from the entire light emitting surface of the LED light source can advantageously be utilized.

Therefore, the lighting device can be configured with fewer LED light sources due to effective light utilization, thereby reducing the number of parts as well as assembly costs. In addition to this, the reduced number of LED light sources can lower the power consumption.

The lighting device of the presently disclosed subject matter can be suitable for use in a vehicle lighting device, examples of which include headlights, high mount stop lights, rear lights, fog lights, and other auxiliary headlights, tail lights, stop lights, center high mount stop lights, front turn signal lights, rear turn signal lights, side marker lights, positioning lights, cornering lights, and other various vehicle and traffic lighting devices.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

A description will now be given of exemplary embodiments that are constructed in accordance with principles of the presently disclosed subject matter with reference to the accompanying drawings.

Figure 1:
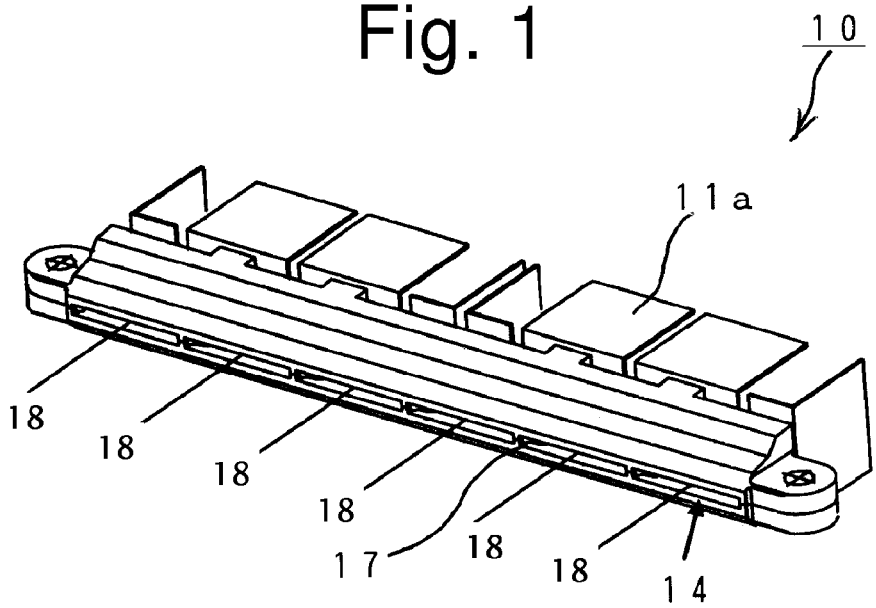
FIG. 1 is a schematic perspective view showing the configuration of a first exemplary embodiment of a lighting device made in accordance with principles of the presently disclosed subject matter.
Figure 2:
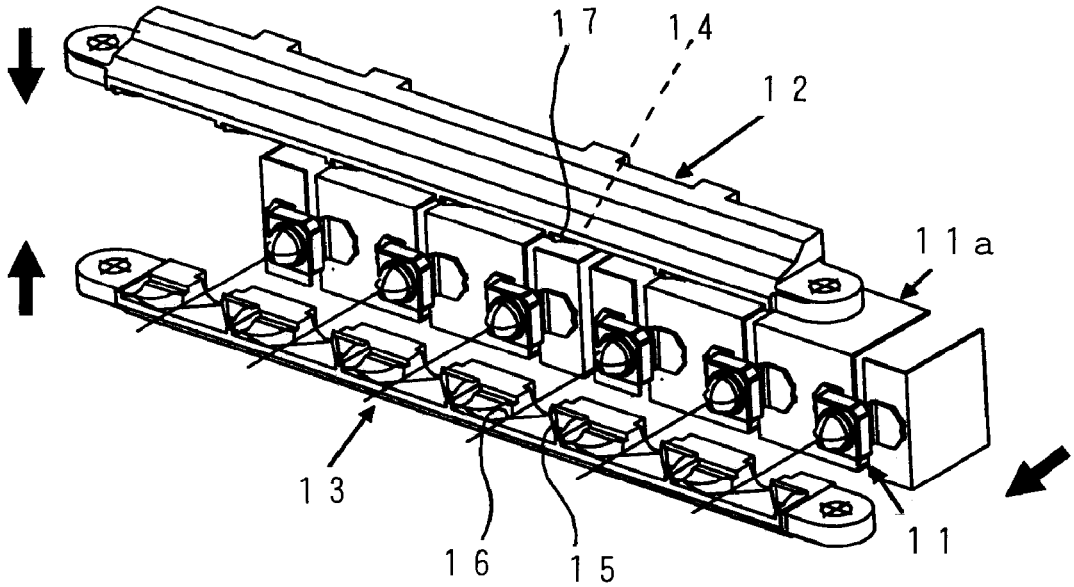
FIG. 2 is an exploded perspective view of the lighting device of FIG. 1.

FIGS. 1 and 2 shows the configuration of a first exemplary embodiment in which the lighting device is configured as a vehicle lighting unit 10 which is used as a headlight. The lighting unit 10 is configured to include a plurality of LED light sources 11 (six (6) in number in the illustrated example) horizontally arranged in line, and a pair of attachment members 12 and 13.

The LED light source 11 can be constituted by using a commercially available general LED light source. The LED light source 11 as shown in FIG. 2 can be constituted as a square high power package and have a light control lens on the front surface of an LED chip for imparting directivity to light. Typical cannon-ball type LED light sources can also be used as the LED light source 11.

The LED light source 11 is mounted on a metal circuit substrate 11*a* to which an appropriate driving voltage can be applied to cause the light source 11 to be turned on.

The attachment members 12 and 13 can be formed having substantially the same shape, and can include a first reflector 14 and a second reflector 15, and a third reflector 16 and a fourth reflector 17, respectively, which are formed adjacent to respective LED light sources 11.

The attachment member 12 and 13 can be made of a resin or a metal by means of, for example, die casting.

The reflectors 14, 15, 16, and 17 can be formed by subjecting the inner surfaces of the attachment members 12 and 13 to thin film surface treatment which may include vapor deposition, sputtering, or the like using a glossy metal such as aluminum, silver, or the like.

In this instance, the upper attachment member 12 is provided with the first reflector 14 and the fourth reflector 17, and the lower attachment member 13 is provided with the second reflector 15 and the third reflector 16 by taking into consideration the mold releasing direction during molding. The attachment members 12 and 13 can be assembled together by means of welding (such as vibration welding), thermal caulking, screwing, adhesion, or other means.

After assembling the attachment members 12 and 13, the metal circuit substrate 11*a*, on which the respective LED light sources 11 have been mounted, is positioned with respect to the rear side of the integrated attachment members 12 and 13, and then is fixed thereto by means of screwing, thermal caulking, welding, or other means.

By doing so, the combined attachment members 12 and 13 define an opening serving as a light emitting portion 18 which is positioned on the optical axis of each of the LED light sources 11 and can have an elongated slit-like shape when the LEDs 11 are arranged in line.

As discussed above, the attachment members 12 and 13 may have the same shape when the assembled members are horizontally separated (see FIG. 2).

A description will now be given of each of the first to fourth reflectors 14 through 17 with reference to FIG. 3.

The first reflector 14 can include a plain mirror or a convex or concave mirror having a large radius of curvature. Its reflecting surface is directed generally opposite to the irradiation direction such that the reflecting surface faces generally towards the light emitting surface of the corresponding LED light source 11.

Figure 3:
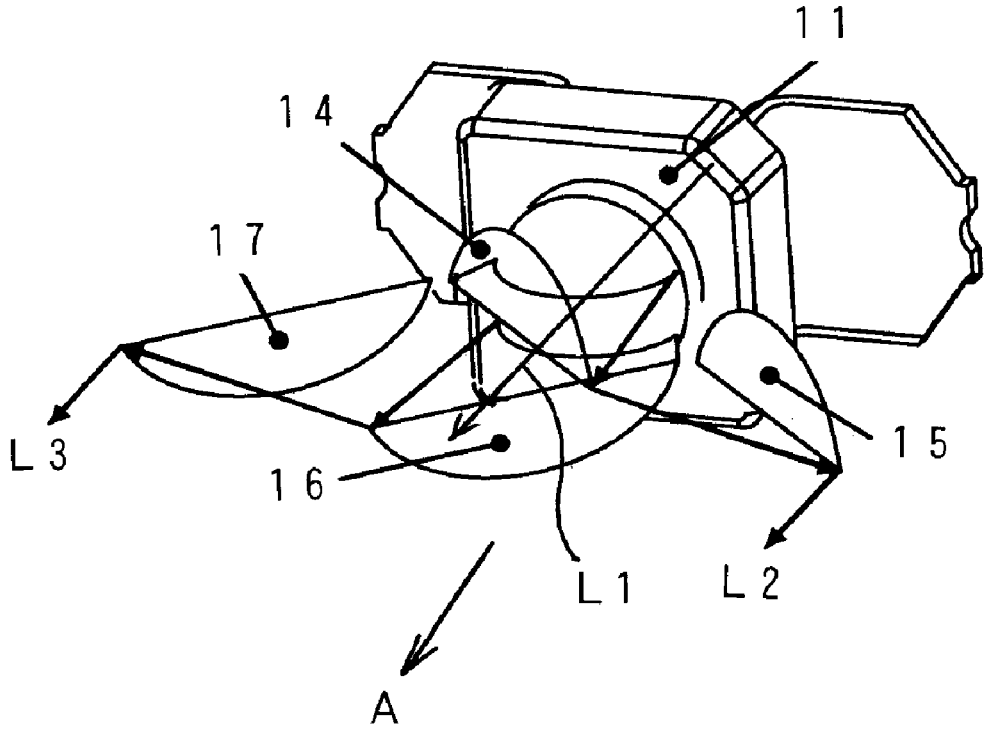
FIG. 3 is a partial enlarged perspective view of the lighting device of FIG. 1, showing the configuration in the vicinity of the LED light source.

In detail, the first reflector 14 is inclined forward from one side to the other side, namely, from the left side to the right side in FIG. 3, by an angle of approximately 45 degrees. In addition to this, the first reflector 14 is slightly inclined downwards, for example, by an angle of approximately 1 to 30 degrees.

The thus configured first reflector 14 corresponds to the upper one-third area of the light emitting surface of the LED light source 11 when the surface is divided into three in the vertical direction. Further to this, the reflector 14 has a wider horizontal width than that of the LED light source 11.

The second reflector 15 can include a plain mirror or a convex or concave mirror having a large radius of curvature. Its reflecting surface is directed to the front direction or the irradiation direction and faces to the reflecting surface of the first reflector 14.

Furthermore, the second reflector 15 is positioned forward of the LED light source 11 and substantially parallel to the first reflector 14. In other words, the second reflector 15 is inclined forward from the one side to the other side, namely, from the left side to the right side in FIG. 3, by an angle of approximately 45 degrees, similarly to the first reflector 14. In addition to this, the second reflector 15 is slightly inclined upwards, for example, by an angle of approximately 1 to 30 degrees. The thus configured second reflector 15 is located at a level substantially corresponding to the center one-third area of the light emitting surface of the LED light source 11.

The third reflector 16 and the fourth reflector 17 are rotationally symmetric to the first reflector 14 and the second reflector 15 with respect to the optical axis of the corresponding LED light source 11. Accordingly, they can have the same or substantially same shape as that of the first and second reflectors when rotated by 180 degrees about the optical axis.

Figure 4:
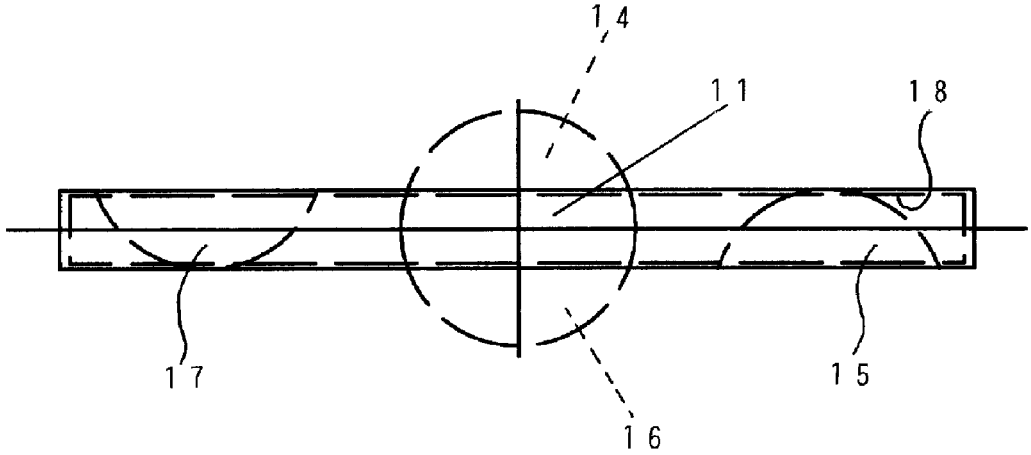
FIG. 4 is a partial enlarged perspective view of the lighting device of FIG. 1, showing the light emitting portion of the LED light source.

When a part of the light emitting portion 18 is viewed from its front side, as shown in FIG. 4, the second reflector 15 and the fourth reflector 17 are arranged at both sides of the LED light source 11 within the elongated light emitting portion 18 such that they function as light emitting surfaces.

In the lighting unit 10 configured as described above for the present exemplary embodiment, light L1 is emitted from the vertical center one-third area of the light emitting surface (light emitting center) is irradiated forwards.

Light L2 is emitted from the vertical upper one-third area of the light emitting surface with respect to the emission center and is incident on the first reflector 14 and reflected to the other side and slightly downwards to be directed towards the second reflector 15.

The light L2 that is incident on the second reflector 15 is reflected by the second reflector 15 forward and substantially horizontally such that it is irradiated in the illumination direction.

Light L3 emitted from the vertical lower one-third area of the light emitting surface with respect to the emission center is incident on the third reflector 16 and reflected to the one side slightly upwards to be directed towards the fourth reflector 17.

The light L3 that is incident on the fourth reflector 17 is reflected by the fourth reflector 17 forward and substantially horizontally such that it is irradiated in the illumination direction.

In this instance, the light L2 emitted from the upper one-third area of the light emitting surface of the LED light source 11 is reflected by the first reflector 14 and the second reflector 15 so as to be irradiated forward at the same level as that of the center one-third area of the light emitting surface of the LED light source 11 while shifted toward the other side. In addition, the light L3 that is emitted from the lower one-third area of the light emitting surface of the LED light source 11 is reflected by the third reflector 16 and the fourth reflector 17 so as to be irradiated forward at the same level as that of the center one-third area of the light emitting surface of the LED light source 11 while also shifted toward the one side.

Therefore, the light L1, light L2, and light L3 emitted from each of the LED light sources 11 is reflected and aligned in the area of the center one-third area of the LED light source 11. Accordingly, the vertical width of the light emitting area can be made one-third of the vertical width of the light emitting surface of the LED light source 11, thereby achieving a lighting device having a narrow width light emitting surface. In one exemplary embodiment, when a general-purpose LED light source with a diameter of 4.5 mm is used as an LED light source 11, the width of the vertical width may be approximately 1.5 mm and the horizontal width may be approximately 13.5 mm.

A certain portion of light emitted from the LED light sources 11 is irradiated forward from the center of the light source, and a remaining portion of light is irradiated forward from both sides of the LED light source 11 by the first and second reflectors 14 and 15 and the third and fourth reflectors 16 and 17, respectively. Accordingly, almost all of the light emitted from the LED light sources 11 is irradiated forward.

In this instance, when the reflectance of the first to fourth reflectors 14 to 17 is approximately 90%, the light utilization efficiency of the LED light sources 11 is as follows: 33% (light emitted from the center one-third area)+33% (light emitted from the upper or lower one-third area)×90% (the reflectance of first or third reflector)×90% (the reflectance of second or fourth reflector)×2(upper and lower areas)=87.3%. The total of the reflectance loss is approximately 13% and the light utilization efficiency is approximately 87%. Accordingly, this can provide an appropriate light distribution property with a sufficient intensity for most circumstances.

Figure 5:
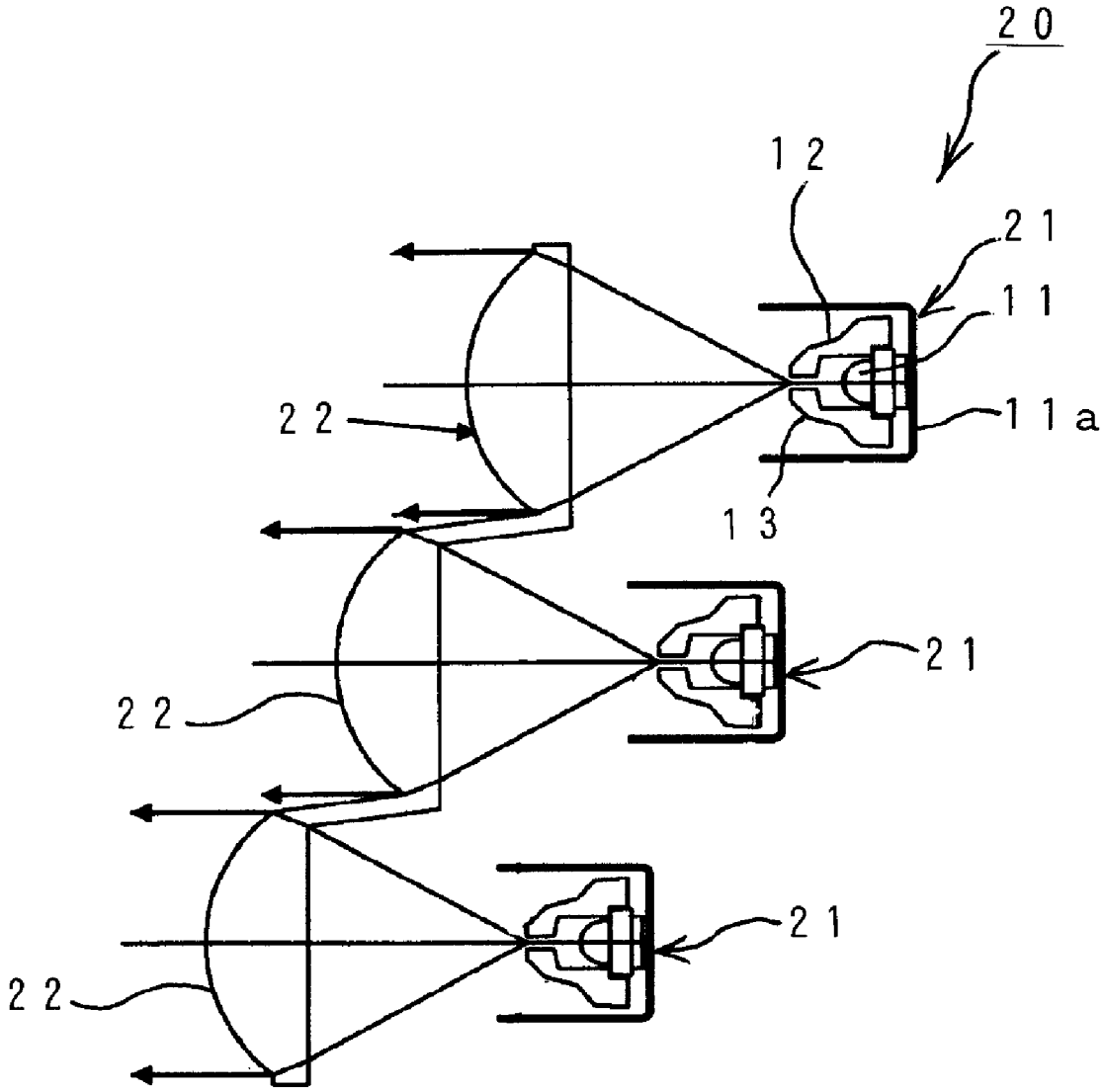
FIG. 5 is a schematic cross sectional view showing the configuration of a second exemplary embodiment of a lighting device made in accordance with principles of the presently disclosed subject matter.

FIG. 5 shows a configuration of a second exemplary embodiment of a lighting device made in accordance with principles of the presently disclosed subject matter.

In FIG. 5, a lighting unit assembly 20 may serve as a headlight for an automobile or other vehicle and has a three-stage structure.

The lighting unit assembly 20 can include three lighting units 21. The units 21 can have the same structure, and accordingly, one lighting unit 21 will be described here. Namely, the unit 21 has almost the same configuration as the lighting unit 10 shown in FIG. 1. In addition to this, a projector lens 22 is provided in front of the light emitting portion 18.

The lighting unit 21 is configured such that the light emitting portion 18 is enlarged and such that light is projected forward by the projector lens 22. In order to enhance the contrast of the light source, the surfaces of the lighting unit 21 (except for the light emitting portion 18) can be made of a material with a low reflectance. For example, the surface of the lighting unit 21 may be painted with black paint or dye, etc., or alternatively the entire surface may be formed of a black-colored material.

The projector lens 22 may be an aspherical lens or a cylindrical lens and has a rear-side focus in the vicinity at which the light emitting portion 18 of the lighting unit 21 is disposed.

In the illustrated example, the projector lenses 22 may be integrally formed together. In this configuration, light emitted from the light emitting portions 18 is enlarged and projected forward by the projector lenses 22, respectively, thereby forming the desired light distribution pattern.

In this case, the light emitted from each of the LED light sources 11 of the lighting units 21 is reflected twice by the first to fourth reflectors 14 to 17, thereby forming a horizontally elongated light emitting portion with a vertical width equal to substantially one-third of the LED light emitting portion. This configuration can define a desired light distribution pattern that has a relatively long horizontal component.

In the above-mentioned lighting unit assembly 20, an optical diffusion member, such as a lens subjected to prism processing for diffusion, a diffusion sheet, a diffusion lens, or other members with a diffusion function, can be provided at or in the light emitting portion 18 in order to suppress light intensity unevenness emitted from the light emitting portion 18 of the lighting unit 21. In this case, the optical diffusion member can diffuse the light emitted from the light emitting portion 18 to reduce the light intensity unevenness.

In the above-mentioned lighting unit assembly 20, the respective lighting units 21 are disposed horizontally and in a lateral direction. However, the presently disclosed subject matter is not limited thereto. The lighting units 21 can be inclined appropriately in order to form a desired light distribution pattern. For example, in order to form a low-beam distribution pattern, the lighting units 21 can be inclined by 15 degrees.

In the above-described lighting unit assembly 20, a projector lens 22 is combined with a lighting unit 21 to provide a so-called projection type headlight. However, the presently disclosed subject matter is not limited thereto. Alternatively, the lighting unit assembly 20 can include a reflection type headlight. Such a reflection type headlight can be configured by combining the above-mentioned lighting unit 21 with a reflecting surface such as a parabolic surface, a multi-reflecting surface, a free curved surface, or other reflecting surfaces, and arranging the light emitting portion 18 of the lighting unit 21 in the vicinity of the focus of the reflecting surface.

A description will now be given of the third exemplary embodiment of a lighting device made in accordance with principle of the presently disclosed subject matter with reference to FIGS. 6 and 7.

Figure 6:
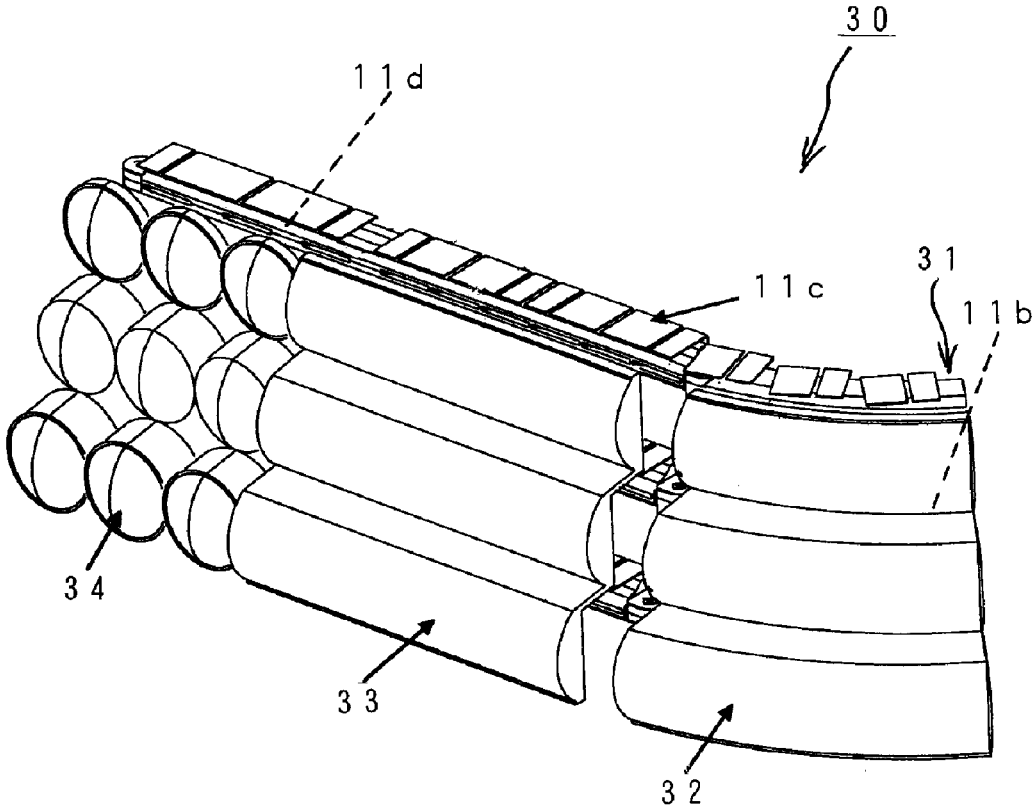
FIG. 6 is a schematic cross sectional view showing the configuration of a third exemplary embodiment of a lighting device made in accordance with principles of the presently disclosed subject matter.
Figure 7:
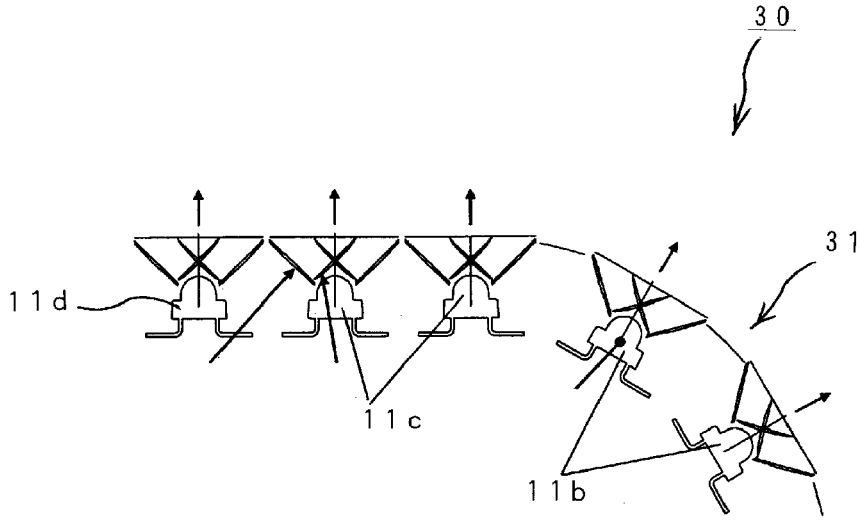
FIG. 7 is a partial enlarged bottom view of the lighting device of FIG. 6.

FIG. 6 shows a lighting unit assembly 30 which is a kind of variation of the lighting unit assembly 20 shown in FIG. 5. The lighting unit assembly 30 is configured to be a left-side headlight and include a three-stage structure.

The lighting unit assembly 30 is composed of three lighting units 31 as in the case of the lighting unit assembly 20 shown in FIG. 5, which has three lighting units 21. As detailed in FIG. 7, a plurality of lighting units 31 each including an LED light source 11*b* and corresponding reflectors 14 to 17 is positioned at one side (in the illustrated example, two lighting devices are positioned at the corner side in the vehicle width direction) as well as arranged along the curved vehicle surface. In this instance, a curved cylindrical lens 32 is disposed in front of the LED light sources 11*b*. Namely, the plurality of LED light sources 11*b* and corresponding reflectors 14 to 17 are arranged along the curved cylindrical lens 32 at the corner side face of the vehicle body.

The other LED light sources 11*c* and 11*d* and the corresponding reflectors 14 to 17 are arranged in line, and among them, the LED light sources 11*c* are provided with a cylindrical lens 33 for diffusion in front of the light sources 11*c*. Furthermore, a plurality of lighting units 31 positioned at the other end (in the illustrated example, three lighting units are positioned inward in the vehicle width direction) are provided with spherical lenses 34 for forming a converged spot light, respectively.

In the present exemplary embodiment, the LED light sources 11*b*, 11*c*, and 11*d* are independently driven to emit respective light.

Figure 8:
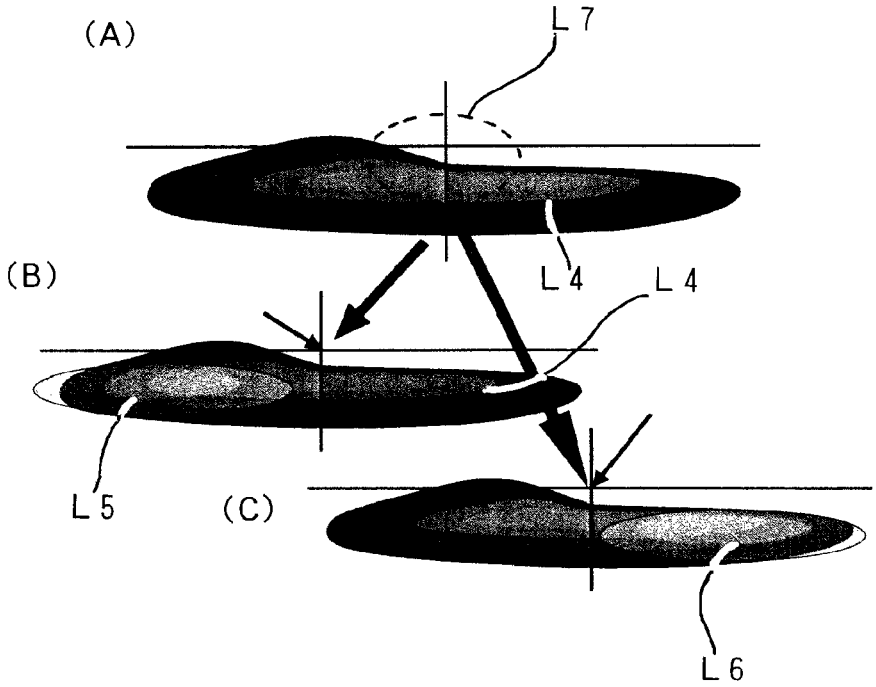
FIGS. 8A, 8B, and 8C are graphs showing the light distribution patterns when traveling in a normal state (8A), when traveling along a left curve (8B), and when traveling along a right curve (8C)

In accordance with the thus configured lighting unit assembly 30, only the LED light sources 11*c* at the center area are turned on during normal traveling so as to form a light distribution pattern as shown in FIG. 8A by the light L4 from the LED light sources 11*c*.

Conversely, the LED light sources 11*b* are tuned on during traveling along a left curve so as to form a light distribution pattern as shown in FIG. 8B by the light L5 from the LED light sources 11*b*, thereby irradiating the road with appropriate light in the traveling direction. This can ensure the visibility in the traveling direction of a vehicle.

When traveling along a right curve, the corresponding LED light sources 11*b* for the right side headlight which is symmetric to the lighting unit assembly 30 are turned on to emit light L6 with a light distribution pattern as shown in FIG. 8C, thereby irradiating the road with appropriate light in the traveling direction. This can ensure the visibility in the traveling direction of a vehicle.

During traveling on an expressway, the LED light sources 11*d* are additionally turned on to emit light L7 as shown in FIG. 8A, with a broken line, thereby irradiating the road with appropriate light in the traveling direction. In this case, the far visibility can be enhanced.

The above-described lighting unit assembly 30 can employ full color LED light sources, which have an RGB chip installed thereinside, in place of a white LED as an LED light source.

In this instance, the respective LED chips of the LED light sources are independently driven to emit light with a variety of colors. For example, when drawing off a driver's attention to, it is possible to adjust the color of light emitted from part of LED light sources within a specification for headlight white color.

Figure 9:
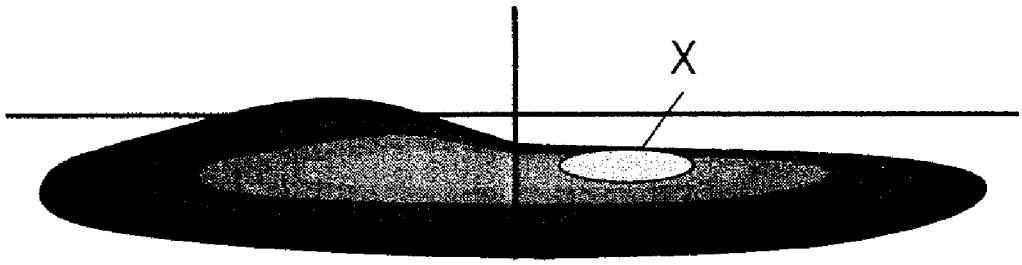
FIG. 9 is a graph showing the light distribution pattern in accordance with a variation of the lighting device of FIG. 5.

In a variation of the present exemplary embodiment, for example, when a pedestrian is detected by a so-called night vision system, the color of the light in the area X as shown in FIG. 9 can be changed to indicate that the pedestrian is present in the area X. Alternatively, the intensity of light can be changed or blinking can be performed for that purpose.

Figure 10:
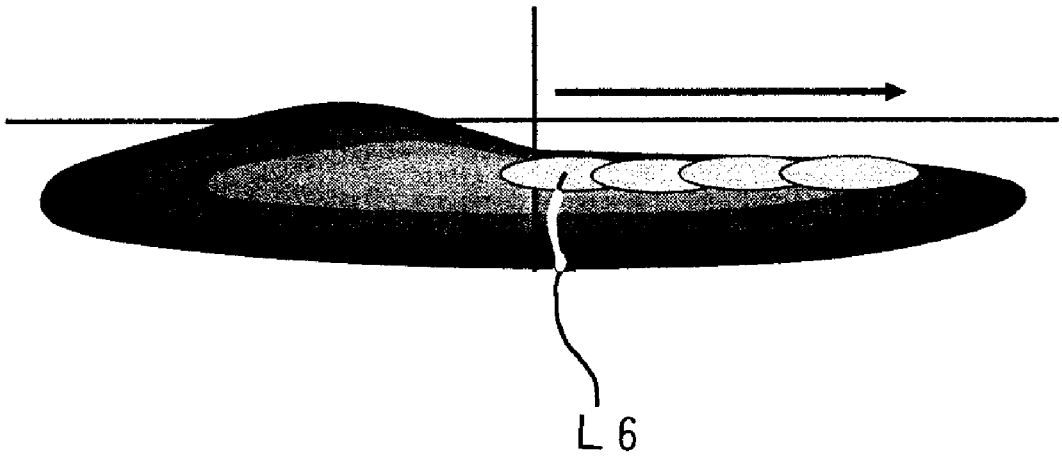
FIG. 10 is a graph showing the light distribution pattern in accordance with another variation of the lighting device of FIG. 5.

In another variation, the lighting unit assembly 30 can be driven in conjunction with a car navigation system. In this case, before entering a curve, LED light sources 11*b* arranged at a curved portion of the vehicle body can be sequentially turned on in accordance with the road information acquired by the car navigation system. In this case, as shown in FIG. 10, the spot light by the light L6 from the LED light sources 11*b* can be sequentially moved laterally.

Figure 11:
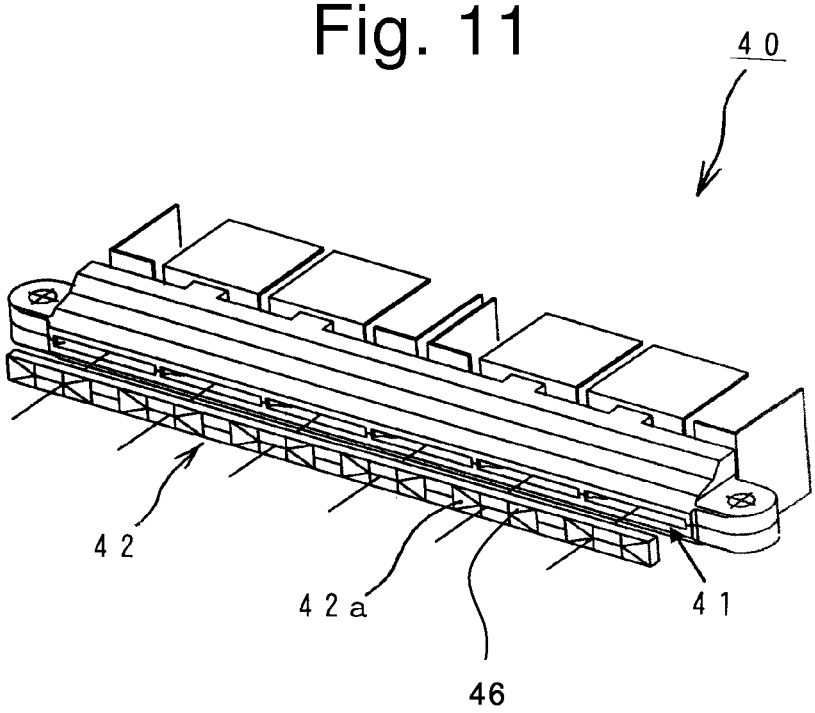
FIG. 11 is a schematic cross sectional view showing the configuration of a fourth exemplary embodiment of a lighting device made in accordance with principles of the presently disclosed subject matter.

FIG. 11 shows the configuration of a fourth exemplary embodiment of a lighting device made in accordance with principles of the presently disclosed subject matter.

In FIG. 11, the lighting unit assembly 40 is configured as a high mount stop light for a vehicle and can be disposed in the rear window of the vehicle. The lighting unit assembly 40 can include a lighting unit 41 that is the same as that of the lighting unit 10 of FIG. 1, and can also include a diffusion lens 42.

The diffusion lens 42 has a lens cut 42*a* formed thereon that includes a number of fine prisms such that it can diffuse light emitted from the LED light sources 11 of the lighting unit 41, thereby providing a desired light distribution property. In addition, a wavelength conversion material (e.g., a phosphorous material 46) can be located on or contained in the diffusion lens 42.

In the thus configured lighting unit assembly 40, the respective LED light sources of the lighting units 41 are turned on to emit light formed as a narrow width light. The light is then further diffused by the diffusion lens 42. This high mount stop lamp can be recognized with high visibility by a driver in another vehicle.

Due to the improved visibility, the lighting unit assembly 40 can be disposed lower than usual when it is mounted as a high mount stop lamp in a rear window. This can widen the rear view of the driver, thereby enhancing the rearward visibility.

Furthermore, the lighting unit assembly 40 can be observed as a linear light source, and therefore it shows a novel and unique appearance unlike the conventional high mount stop lamp composed of bulbs or LED light sources alone.

Figure 12:
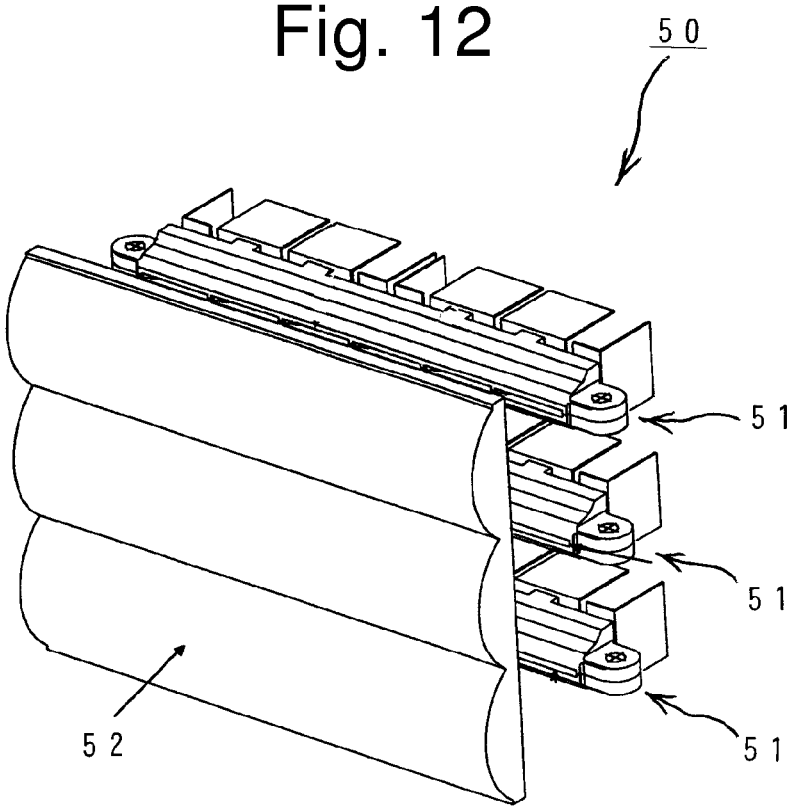
FIG. 12 is a schematic cross sectional view showing the configuration of a fifth exemplary embodiment of a lighting device made in accordance with principles of the presently disclosed subject matter.

FIG. 12 shows the configuration of the fifth exemplary embodiment of a lighting device made in accordance with principles of the presently disclosed subject matter.

In FIG. 12, the lighting unit assembly 50 may serve as a rear light for a vehicle and has a three-stage structure.

The lighting unit assembly 50 is composed of three lighting units 51. The units 51 have the same structure, and accordingly, one lighting unit 51 will be described here.

Namely, the lighting unit 51 has the same structure as that of the lighting unit 21 of FIG. 5 or the lighting unit 10 of FIG. 1, and it is disposed on a rear part of the vehicle body. Furthermore, cylindrical lenses 52 are disposed so as to face the respective light emitting portions 18.

The cylindrical lens 52 has a focus in the vicinity at which the light emitting portion 18 of the lighting unit 51 is positioned so that the cylindrical lens 52 can diffuse light from the respective LED light sources of the corresponding lighting unit 51.

The cylindrical lens 52 can have a desired optical property in order to provide a desired light distribution property suitable for, for example, a turn signal light, a tail light, a stop light, a backup light, etc.

When the LED light sources are turned on, linear, narrow-width light is emitted from the lighting unit 51, and is further diffused by the cylindrical lens 52 and irradiated rearwards. This irradiated linear light can be observed by a driver in another vehicle. In this instance, the respective lighting units 51 of the lighting unit assembly 50 can be separately used to show different functions. In addition to this, the lighting units 51 can be formed thin in the depth direction, thereby enhancing the degree of freedom for disposing the device in the rear area of a vehicle.

Figure 13:
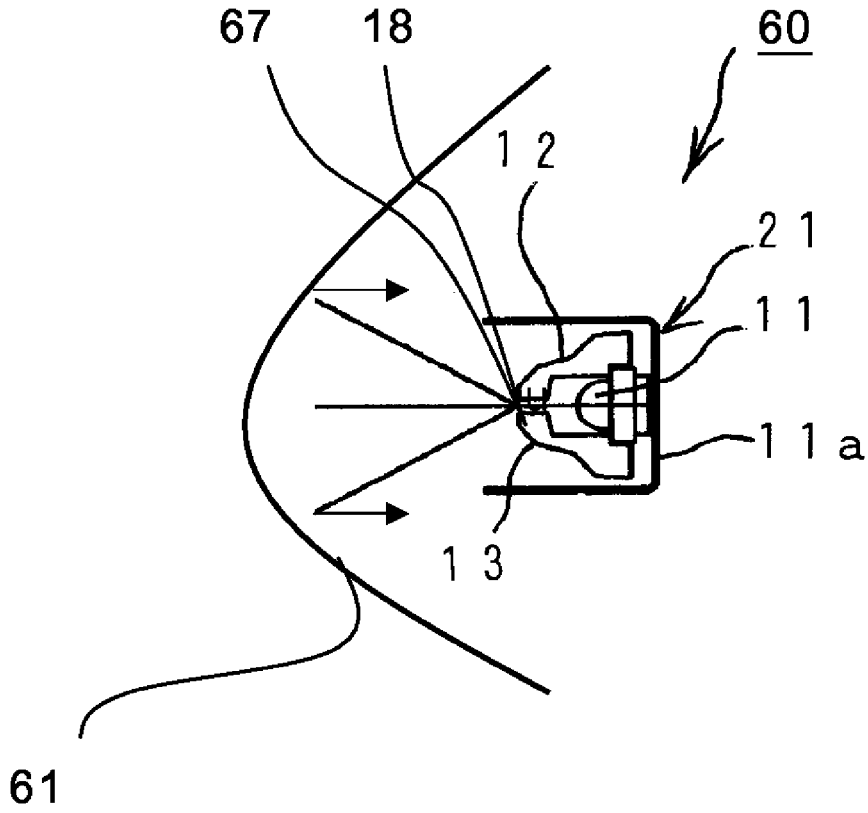
FIG. 13 is a schematic cross sectional view showing the configuration of another exemplary embodiment of a lighting device made in accordance with principles of the presently disclosed subject matter.

FIG. 13 shows the configuration of yet another exemplary embodiment of a lighting device made in accordance with principles of the presently disclosed subject matter. In FIG. 13, the lighting device includes a lighting unit assembly 60 that has a lighting unit 21 configured similar to that of the embodiment shown in FIG. 5. However, in this case, the lighting unit 21 has a light emitting portion 18 in which an optical diffusion member 67 is provided. The optical diffusion member 67 can include a wavelength conversion material (e.g., a phosphor), for changing the color of light that is emitted from the LED 11. Furthermore, an additional reflector 61 can be located at a first focus of a light emitting portion of the lighting unit 21 such that the additional reflector 61 reflects light into a predetermined direction and with a predetermined light distribution. The additional reflector 61 can be configured as a parabolic surface reflector, a multi reflector surface, a free curved surface, or the like.

In the above-described embodiments, the lighting devices have their LED light sources 11 arranged horizontally. However, the presently disclosed subject matter is not limited thereto. The lighting device can have LED light sources disposed vertically or diagonally or otherwise to provide a unique, aesthetic appearance with a linear narrow width light emitting portion.

In the above-described embodiments, the lighting devices have their LED light sources 11 configured as white LEDs or three-colored LEDs. However, the presently disclosed subject matter is not limited thereto. For example, a blue LED can be used as an LED light source, and a sheet coated with a phosphor can be disposed in the vicinity of the light emitting portion 18. When the blue LED is driven to emit light, the blue light emitted therefrom is incident on the sheet and is wavelength-converted into another colored fluorescence. The blue light and the wavelength-converted light can then be mixed to provide white light.

In the above-described embodiments, the lighting units 10, 21, 31, 41, and 51 each have a plurality (for example six) of LED light sources 11. However, the presently disclosed subject matter is not limited thereto. It is sufficient for the lighting device to have at least one LED light source 11. In this instance, the number of LED light sources can be appropriately determined in accordance with a desired light distribution pattern, a desired luminous intensity, or other desired specifications.

In the above-described embodiments, the lighting unit assemblies 10 to 50 serve as a headlight, a high mount stop light, or a rear light. However, the presently disclosed subject matter is not limited thereto. The lighting device of the presently disclosed subject matter can be suitable for use in a vehicle lighting device, examples of which include fog lights, and other auxiliary headlights, tail lights, stop lights, center high mount stop lights, front turn signal lights, rear turn signal lights, side marker lights, positioning lights, cornering lights, and other various vehicle lighting devices.

The lighting device can have a simple configuration with a narrow vertical width and without deteriorating the light take-out efficiency, and can be manufactured at low cost. The lighting device can also provide high versatility.

While there has been described what are at present considered to be exemplary embodiments of the presently disclosed subject matter, it will be understood that various modifications may be made thereto, and it is intended that the appended claims cover such modifications as fall within the true spirit and scope of the presently disclosed subject matter.

What is claimed is:

1. A lighting device having a first side and a second side comprising:

at least one LED light source having at least one LED chip and an optical axis, the LED light source configured to impart a certain directivity to light emitted in a forward direction from the LED chip in a direction of the optical axis;

a first reflector disposed in front of the LED light source and upwards with respect to the optical axis when viewed from a front of the device, the first reflector extending forward and above the optical axis in an inclined manner from the first side to a second side so as to reflect part of light emitted from an upper part of the LED light source with respect to the optical axis;

a second reflector disposed substantially in parallel with, and below, the first reflector, the second reflector configured to reflect light received from the first reflector;

a third reflector disposed in front of the LED light source and downwards with respect to the optical axis when viewed from a front of the device, the third reflector extending forward and below the optical axis in an inclined manner from the second side to the first side so as to reflect at least a portion of light emitted from a lower part of the LED light source with respect to the optical axis; and a fourth reflector disposed substantially in parallel with, and above, the third reflector, the fourth reflector configured to reflect light received from the third reflector.

2. The lighting device according to claim 1, wherein the first reflector, the second reflector, the third reflector, and the fourth reflector in combination are rotationally symmetric with respect to the optical axis of the LED light source.

3. The lighting device according to claim 1, wherein:

the LED light source has a light emitting surface with a specified size and specified width;

the first reflector is disposed at a position corresponding to an upper one-third area of the light emitting surface of the LED light source and has a width that is wider than the width of the light emitting surface;

the third reflector is disposed at a position corresponding to a lower one-third area of the light emitting surface of the LED light source; and the second and fourth reflectors are disposed at the same level as that of the center one-third area of the light emitting surface of the LED light source.

4. The lighting device according to claim 3, wherein:

the LED light source is supported by an attachment member, and a molded part having a surface is integrally formed with the attachment member;

the first to fourth reflectors are formed in the surface of the molded part; and the molded part includes upper and lower halves which are separated at a center portion and each have at least one reflecting surface that includes a reflection surface treatment.

5. The lighting device according to claim 4, wherein the molded part has a light emission portion with respect to the LED light sources, and the light emission portion is provided with an optical diffusion member.

6. The lighting device according to claim 4, wherein the molded part has a light emission portion with respect to the LED light sources, and the light emission portion is provided with a member that includes a phosphor material.

7. The lighting device according to claim 1, wherein:

the LED light source is supported by an attachment member, and a molded part having a surface is integrally formed with the attachment member;

the first to fourth reflectors are formed in the surface of the molded part; and the molded part includes upper and lower halves which are separated at a center portion and each have at least one reflecting surface that includes a reflection surface treatment.

8. The lighting device according to claim 7, further comprising:

a plurality of the LED light sources, wherein the attachment member is shared by the LED light sources.

9. The lighting device according to claim 7, wherein the molded part has a light emission portion with respect to the LED light sources, and the light emission portion is provided with an optical diffusion member.

10. The lighting device according to claim 9, further comprising:

an additional reflector that includes at least one of a parabolic surface, a multi-reflector surface, and a free curved surface, wherein the additional reflector has a focus located substantially at a light emitting portion of the LED light source.

11. The lighting device according to claim 9, further comprising:

a lens including at least one of a projector lens and a cylindrical lens, wherein the lens has a focus located substantially at a light emitting portion of the LED light source.

12. The lighting device according to claim 7, wherein the molded part has a light emission portion with respect to the LED light sources, and the light emission portion is provided with a member that includes a phosphor material.

13. The lighting device according to claim 12, further comprising:

an additional reflector that includes at least one of a parabolic surface, a multi-reflector surface, and a free curved surface, wherein the additional reflector has a focus located substantially at a light emitting portion of the LED light source.

14. The lighting device according to claim 12, further comprising:

a lens including at least one of a projector lens and a cylindrical lens, wherein the lens has a focus located substantially at a light emitting portion of the LED light source.

15. The lighting device according to claim 7, further comprising:

an additional reflector that includes at least one of a parabolic surface, a multi-reflector surface, and a free curved surface, wherein the additional reflector has a focus located substantially at a light emitting portion of the LED light source.

16. The lighting device according to claim 15, further comprising:

a plurality of the LED light sources, wherein a portion of the LED light sources is arranged such that the first to fourth reflectors reflect light in a direction that is inclined in a predetermined direction with respect to a horizontal axis.

17. The lighting device according to claim 15, further comprising:

a plurality of LED light sources, wherein the LED light sources have respective LED chips having different colors.

18. The lighting device according to claim 15, further comprising:

a plurality of the LED light sources, wherein each of the LED light sources is adjustable with respect to luminous intensity and at least one LED light source has a luminous intensity that is different from another of the LED light sources.

19. The lighting device according to claim 7, further comprising:

a lens including at least one of a projector lens and a cylindrical lens, wherein the lens has a focus located substantially at a light emitting portion of the LED light source.

20. The lighting device according to claim 7, further comprising:

a plurality of the LED light sources, wherein a portion of the LED light sources is arranged such that the first to fourth reflectors reflect light in a direction that is inclined in a predetermined direction with respect to a horizontal axis.

21. The lighting device according to claim 7, further comprising:

a plurality of LED light sources, wherein the LED light sources have respective LED chips having different colors.

22. The lighting device according to claim 7, further comprising:

a plurality of the LED light sources, wherein each of the LED light sources is adjustable with respect to luminous intensity and at least one LED light source has a luminous intensity that is different from another of the LED light sources.

23. The lighting device according to claim 1, further comprising:

a plurality of the LED light sources, wherein a portion of the LED light sources is arranged such that the first to fourth reflectors reflect light in a direction that is inclined in a predetermined direction that is different from a direction of light directed by another portion of the LED light sources.

24. The lighting device according to claim 1, further comprising:

a plurality of LED light sources, wherein the LED light sources have respective LED chips having different colors.

25. The lighting device according to claim 1, further comprising:

a plurality of the LED light sources, wherein each of the LED light sources is adjustable with respect to luminous intensity and at least one LED light source has a luminous intensity that is different from another of the LED light sources.

26. The lighting device according to claim 1, further comprising:

a plurality of the LED light sources, wherein a portion of the plurality of LED light sources includes LED light sources that are arranged at positions such that the optical axis of adjacent ones of the portion of LED light sources are not parallel with respect to each other and such that the portion of the LED light sources provides lighting directed from a side of the device.

27. The lighting device according to claim 1, further comprising:

a plurality of the LED light sources, wherein at least a portion of the LED light sources including the first to fourth reflectors are arranged at positions such that an imaginary longitudinal axis line extending through the portion of LED light sources is rotated around an optical axis of the lighting device and at an angle greater than zero with respect to a horizontal axis.

* * * * *

UNITED STATES PATENT AND TRADEMARK OFFICE

CERTIFICATE OF CORRECTION

PATENT NO. : 7,441,928 B2
APPLICATION NO. : 11/736216
DATED : October 28, 2008
INVENTOR(S) : Takashi Futami It is certified that error appears in the above-identified patent and that said Letters Patent is hereby corrected as shown below:

Col. 14 lines 21 - 45 Claim 1 should be corrected as follows:

1. A lighting device having a first side and a second side comprising:
at least one LED light source having at least one LED chip and an optical axis, the LED light source configured to impart a certain directivity to light emitted in a forward direction from the LED chip in a direction of the optical axis;
a first reflector disposed in front of the LED light source and upwards with respect to the optical axis when viewed from a front of the device, the first reflector extending forward and above the optical axis in an inclined manner from the first side to the second side so as to reflect part of light emitted from an upper part of the LED light source with respect to the optical axis;
a second reflector disposed substantially in parallel with, and below, the first reflector, the second reflector configured to reflect light received from the first reflector;
a third reflector disposed in front of the LED light source and downwards with respect to the optical axis when viewed from a front of the device, the third reflector extending forward and below the optical axis in an inclined manner from the second side to the first side so as to reflect at least a portion of light emitted from a lower part of the LED light source with respect to the optical axis; and
a fourth reflector disposed substantially in parallel with, and above, the third reflector, the fourth reflector configured to reflect light received from the third reflector.

Signed and Sealed this

Second Day of March, 2010

David J. Kappos

David J. Kappos
*Director of the United States Patent and Trademark Office*